US008833563B1

(12) United States Patent
Schneider et al.

(10) Patent No.: US 8,833,563 B1
(45) Date of Patent: Sep. 16, 2014

(54) DEDUSTING APPARATUS WITH DUAL OFFSET DISCHARGE PORTS

(75) Inventors: Heinz Schneider, Lancaster, PA (US); Paul Wagner, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 0 days.

(21) Appl. No.: 13/474,010

(22) Filed: May 17, 2012

Related U.S. Application Data

(63) Continuation-in-part of application No. 13/041,678, filed on Mar. 7, 2011.

(60) Provisional application No. 61/319,251, filed on Mar. 30, 2010, provisional application No. 61/489,460, filed on May 24, 2011.

(51) Int. Cl.
*B07B 4/00* (2006.01)

(52) U.S. Cl.
USPC ..... 209/137; 209/149

(58) Field of Classification Search
USPC ..... 209/133, 136–141, 145, 149
See application file for complete search history.

(56) References Cited

U.S. PATENT DOCUMENTS

| | | | | |
|---|---|---|---|---|
| 1,941,212 | A * | 12/1933 | Johnson | 209/2 |
| 5,035,331 | A | 7/1991 | Paulson | |
| 6,595,369 | B2 | 7/2003 | Paulson | |
| 7,380,670 | B2 | 6/2008 | Paulson et al. | |
| 8,016,116 | B2 | 9/2011 | Schneider | |

* cited by examiner

*Primary Examiner* — Joseph C. Rodriguez
*Assistant Examiner* — Kalyanavenkateshware Kumar
(74) *Attorney, Agent, or Firm* — Miller Law Group, PLLC

(57) ABSTRACT

A dedusting apparatus is formed with back-to-back wash decks sloped downwardly and outwardly from a central inlet opening through which contaminated particulate material in directed onto the wash decks. The wash decks terminate at discharge edges from which particulate material enters a Venturi zone outwardly from each wash deck. The housing for the dedusting apparatus includes a pair of laterally spaced outlet ports located below the respective Venturi zones for the collection of cleaned particulate material simultaneously with identical or different collection devices such that the discharge outlets are offset laterally from the central inlet opening. The discharge ends of the wash decks are supported by an angularly disposed support leg. The air manifold directs air into the apparatus through a central opening from which the air passes through openings in the two sloped wash decks and past the discharge edges of the wash decks to create the Venturi zones.

20 Claims, 10 Drawing Sheets

DEDUSTING APPARATUS WITH DUAL OFFSET DISCHARGE PORTS

CROSS-REFERENCE TO RELATED APPLICATIONS

This application is a continuation-in-part of U.S. patent application Ser. No. 13/041,678, filed on Mar. 7, 2011, and claims domestic priority on U.S. Provisional Patent Application Ser. No. 61/319,251, filed Mar. 30, 2010, and on U.S. Provisional Patent Application Ser. No. 61/489,460, filed on May 24, 2011, the contents of which are incorporated herein by reference.

FIELD OF THE INVENTION

The invention disclosed in this application is directed generally to an apparatus for the cleaning and handling of particulate materials, such as plastic pellets, grains, glass, and the like, and particularly to the a dedusting apparatus that can be utilized with product feed conduits extending at an angle to vertical.

BACKGROUND OF THE INVENTION

It is well known, particularly in the field of transporting and using particulate materials, commonly powders, granules, pellets, and the like, that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, streamers (ribbon-like elements that can "grow" into quite long and tangled), glass fibers in glass filled products, that can impede the flow of materials. The characteristics of such a transport system are quite well known, as is the importance and value of keeping product particles as free as possible of contaminants.

The term "contaminant" as used herein includes a broad range of foreign material and includes foreign material as well as broken particles or streamers of the product being transported. The generation of contaminants, also referred to as dust, including microdust, can be from a large number of sources, including, in the way of examples, the creation of dust particles during the processing of plastic pellets in which the larger particles are segregated to be re-ground; organic matter in food grains, such as shells and hulls; the creation of dust in the formation of iron ore pellets; and, as noted previously, the mere conveyance of the pellets in pipes and other mechanical conveying and handling systems. Using plastics as an example, such foreign material could have a detrimental effect on the finished product. Specifically, foreign material different in composition from the primary material, such as dust, and non uniform material of the primary product, such as streamers, would not necessarily have the same melting temperatures as the primary product and would cause flaws when the plastics material is melted and molded. Furthermore, streamers can impact the weighing scale and plug the dosing screws at bagging stations.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and are, therefore, unsellable. It is important to note that since these same non-uniform materials often do not melt at the same temperature as the primary product, the unmelted contaminants cause friction and premature wear to the molding machines, resulting in downtime, lost production, reduced productivity, increased maintenance and thus increased overall production costs.

Since dust and other contaminants are generated mostly by the transport system, it is of primary importance to not only provide apparatus for thoroughly cleaning the particles, but to do so as close to the point of use of the particles as possible so as to avoid the generation of contaminants through additional transport. Accordingly, compact dedusters have been used for many years to clean materials in this application, capable of handling smaller volumes of product, yet also capable of thoroughly cleaning the product. The compact dedusters permit the installation of the deduster immediately before final use of the products, such as being installed directly on top of molding machines or extruders, or on top of silos, as well as under silos, before packaging and bagging, rather than at an earlier stage after which re-contamination can occur before the products are utilized. Of course, the dedusters can be installed as a free standing unit, as well.

Dedusters used to clean contaminants from particulate material can be found in U.S. Pat. No. 5,035,331, granted to Jerome I. Paulson on Jul. 30, 1991, in which air is blown upwardly through wash decks over which a flow of contaminated particulate material is passed so that the flow of air up through the wash decks removes the contaminants from the material flow. A magnetic field is provided by the deduster so that the particulate material flow passes through the magnetic field to neutralize the static charge on the particulates and facilitate the removal of the contaminants from the material. The flow of contaminant laden air is discharged from the deduster, while the cleaned particulate material is passed on to the manufacturing process.

A compact dedusting apparatus is disclosed in U.S. Pat. No. 6,595,369, granted on Jul. 22, 2003, to Jerome I. Paulson. Like the larger dedusting apparatus depicted in U.S. Pat. No. 5,035,331, the follow of particulate material is cleansed of contaminates that have had the static charged attracting the contaminates to the particulates neutralized. The cleaning process utilizes a flow of air passing through the stream of particulate material passing over wash decks. The contaminate-laden air is discharged through the top of the dedusting apparatus, while the cleaned particulate material is discharged from the bottom of the deduster.

In U.S. Pat. No. 7,380,670, granted on Jun. 3, 2008, to Jerome I. Paulson, et al, and in U.S. Pat. No. 8,016,116, granted on Sep. 13, 2011, to Heinz Schneider, the dedusting apparatus includes a pair of oppositely directed wash decks receiving contaminated particulate material from a common infeed port. The infeed mechanism divides the material flow between the two opposing wash decks and directs the particulate material over a flow of air passing through the first wash decks, then through laterally spaced Venturi zones and onto inwardly directed secondary wash decks that direct the cleaned particulate material into a central discharge opening. Air flow to the primary and secondary wash decks is directed through a rearwardly located manifold that has a central primary opening and laterally spaced lower openings below the secondary wash decks.

These compact dedusters are provided with single and double (back-to-back) wash decks and are utilized with a vertically oriented conduit in which particulate material is conveyed to the manufacturing apparatus utilizing the particulate material. Accordingly, the product inlet opening at the top of the dedusting apparatus is in vertical alignment with the cleaned product outlet opening. The particulate material is introduced into the inlet opening and is metered onto a diagonally oriented primary wash deck through which air is blown from an air supply inlet to clean dust and debris from the particulate material flowing over the wash deck. In these dedusting devices, the particulate material is discharged off the lower end of the wash deck and falls through a Venturi zone in which air is moving upwardly to provide a vigorous cleaning action to the particulate material. The material falling through the Venturi zone is received on a secondary wash deck that is oriented oppositely of the primary wash deck to direct material back to the centrally aligned cleaned product outlet opening.

Further, with a single inlet and a single outlet, the conventional dedusting apparatus is limited in operation to being utilized to feed a single receiver of the cleaned particulate material passing through the dedusting apparatus. As is noted above, the discharge from the dedusting apparatus is typically used to load railroad cars or trucks, or to be received in a collection bag. With a single discharge outlet in the dedusting apparatus, the receiver can only be one of these conventional devices.

With increasing capacity of the dedusting apparatus, it would be advantageous to provide for multiple receivers of the cleaned particulate material from a single dedusting apparatus. With multiple discharge openings, two bagging stations could be filled simultaneously.

SUMMARY OF THE INVENTION

It is an object of this invention to overcome the disadvantages of the prior art by providing an apparatus for removing dust and debris from particulate material from which multiple discharge outlets can be used.

It is another object of this invention to provide a dedusting apparatus with multiple discharge ports.

It is an advantage of this invention that different disposal devices can be utilized to collect cleaned particulate material from a single dedusting apparatus.

It is a feature of this invention that the dedusting apparatus does not include a secondary wash deck.

It is another feature of this invention that the air manifold directs air underneath the primary wash deck to pass through openings in the wash deck and around the discharge edge of the wash deck to create a Venturi zone through which the particulate material must pass before being discharged from the dedusting apparatus.

It is another advantage of this invention that the discharge ports are offset relative to the inlet opening through which the contaminated particulate material passes into the dedusting apparatus.

It is still another feature of this invention that the dirty air discharge from the dedusting apparatus is located above the Venturi zone on both sides of the primary wash deck.

It is still another advantage of this invention that the collection of cleaned particulate material in bags is facilitated by having dual discharge outlets.

It is still another object of this invention to support each wash deck with a support member that angles inwardly from the discharge edge of the wash deck to the floor of the housing.

It is yet another feature of this invention that the support member is formed with slotted openings to direct a flow of air from the air manifold through the support member and into the Venturi zone.

It is a further feature of this invention that the smallest horizontal dimension for the Venturi zone is located at the discharge edge of the wash deck.

It is yet another advantage of this invention that the cleaning of dirt and debris from particulate material at the Venturi zone is improved by utilizing an angled support member for the wash deck.

It is still another object of this invention to provide a dual discharge outlet dedusting apparatus, which is durable in construction, inexpensive of manufacture, carefree of maintenance, facile in assemblage, and simple and effective in use.

These and other objects features and advantages are accomplished according to the instant invention by providing a dedusting apparatus formed with back-to-back wash decks sloped downwardly and outwardly from a central inlet opening through which contaminated particulate material in directed onto the wash decks. The wash decks terminate at discharge edges from which particulate material enters a Venturi zone outwardly from each wash deck. The housing for the dedusting apparatus includes a pair of laterally spaced outlet ports located below the respective Venturi zones for the collection of cleaned particulate material simultaneously with identical or different collection devices such that the discharge outlets are offset laterally from the central inlet opening. The discharge ends of the wash decks are supported by an angularly disposed support leg. The air manifold directs air into the apparatus through a central opening from which the air passes through openings in the two sloped wash decks and past the discharge edges of the wash decks to create the Venturi zones.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
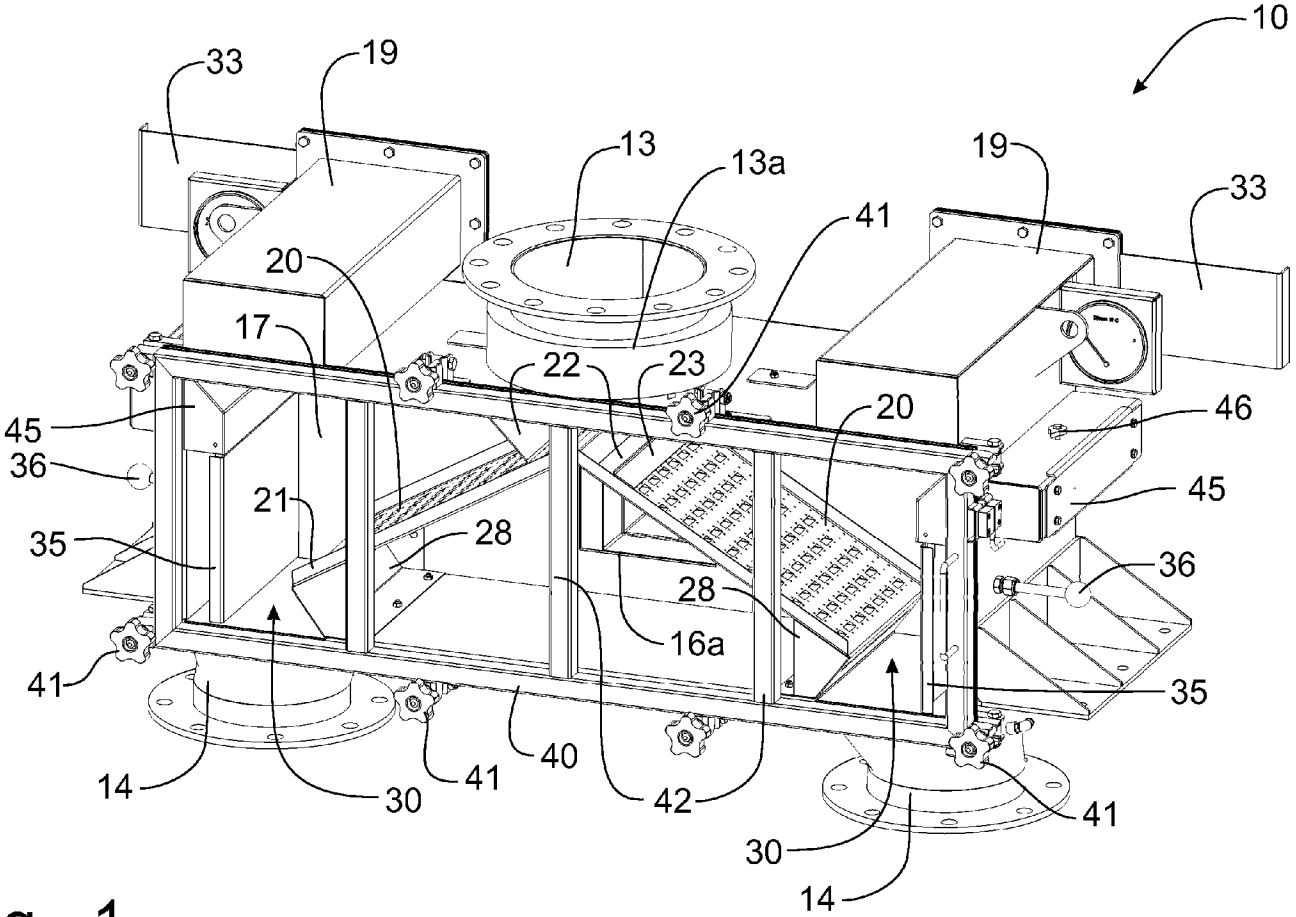
FIG. 1 is a schematic front perspective view of a dedusting apparatus incorporating the principles of the instant invention.

The dedusting apparatus is known in the art. A general description of the structure and operation of a conventional dedusting apparatus and a conventional compact dedusting apparatus can be found in U.S. Pat. No. 5,035,331 and in U.S. Pat. No. 6,595,369, both of which were issued to Jerome I. Paulson, the contents of each of these patents being incorporated herein by reference. Typical particulate material to be cleaned by the dedusting apparatus 10 is plastic pellets that are to be passed into an injection molding machine to form plastic components. Examples of plastic particulate material that can be cleaned of contaminate material by the dedusting apparatus 10 are polyester, acrylic, high density polyethylene, polypropylene, nylon, polycarbonates, styrene, and low density polyethylene. Other types of particulate material that can be cleaned in the dedusting apparatus 10 include glass particles and grain.

Referring to FIGS. 1-9, the dedusting apparatus 10, incorporating the principles of the instant invention, defines a central product inlet port 13 that is typically connected to a vertical portion of a fluent material handling system (not shown) such that the particulate material is fed into a product inlet port 13 located at the transverse center at the top of a generally airtight main housing 11. The main housing 11 has supports a pair of oppositely directed wash decks 20 that receive particulate material to be cleaned from the inlet port 13, as will be described in greater detail below. The main housing also defines an air inlet passageway 15 having an air inlet port 16 in the rear wall 12 of the main housing 11. As will be described in greater detail below, the introduction of an air flow through the air inlet port 16 will direct air through the wash decks to clean the particulate material.

The product inlet port 13 directs product particulates onto the wash decks 20 for cleaning. A magnetic coil 13*a* generates a magnetic flux field and is mounted at the inlet port 13 so that the flow of particulate material into the main housing 11 to be cleaned is subjected to the magnetic flux field to neutralize the static charges on the particulate pellets, thus making the separation of the contaminates, particularly microdust, from the pellets easier to accomplish. Air is fed into the housing 11 through the clean air inlet port 16 through the rear wall 12 to direct a flow of clean air into the housing 11, as will be described in greater detail below. A portion of the clean air passing through the inlet opening 16 is directed upwardly through the wash decks 20, while a remaining portion of the clean air flowing into the housing 11 is distributed to the Venturi zones 30, as will be described in greater detail below. One skilled in the art will recognize that baffles (not shown) may have to be provided to accomplish the desired division of the clean air flow between the wash decks 20 and the Venturi zones 30.

The wash decks 20 are supported by the housing 11 to present a downwardly sloping surface in opposite directions from the product inlet port 13 to the transversely spaced product outlet ports 14 over which the product to be cleaned, in the form of particulate particles, moves by gravity. An inlet deflector 22 is mounted to the housing 11 in a manner as to be slidable along the top surface of the housing 11 for directing the product particulates onto the wash deck 20. The inlet deflector 22 includes a trailing leg 23 that is oriented generally parallel to the slope of the wash deck 20 to force the product particulates into a laminar flow downwardly over the surface of the wash deck 20 toward the outlet port 14. The sliding movement of the inlet deflector 22 can be effected by manipulation of the adjustment pins 22*a* projecting through the housing 11 to allow adjustment of the depth of the laminar flow by positionally moving the inlet deflector 22 to the desired position.

The wash deck 20 is formed as a sloped tray having a top surface 24 in which are formed generally horizontal slots 25 and circular openings. The horizontal slots 25 are formed in conjunction with an upwardly extending deflector that presents a ramp to the product particulates moving downwardly over the top surface 24 of the wash deck 20. The slot 25 is formed as the horizontal opening across the top surface 24 between the deflector and the top surface 24, such that the air flowing through the slot 25 is directed by the deflector into the product in a generally horizontal direction, which is slightly upwardly with respect to the slope of the top surface 24 of the wash deck 20. Air moving through the circular openings is directed generally perpendicularly to the sloped top surface 24 of the wash deck 20. The net operative result is that the product particulates are subjected to a downward acceleration along the surface of the wash deck and to a turbulence generated by the movement of the particulates over the deflectors and by the substantially perpendicular air flow streams emanating from the circular openings and the horizontal slots 25. Accordingly, dust and debris contaminates are released from the product particulates and are carried by the air flow to the dirty air exhaust port 19 at the top of the housing 11.

Figure 10:
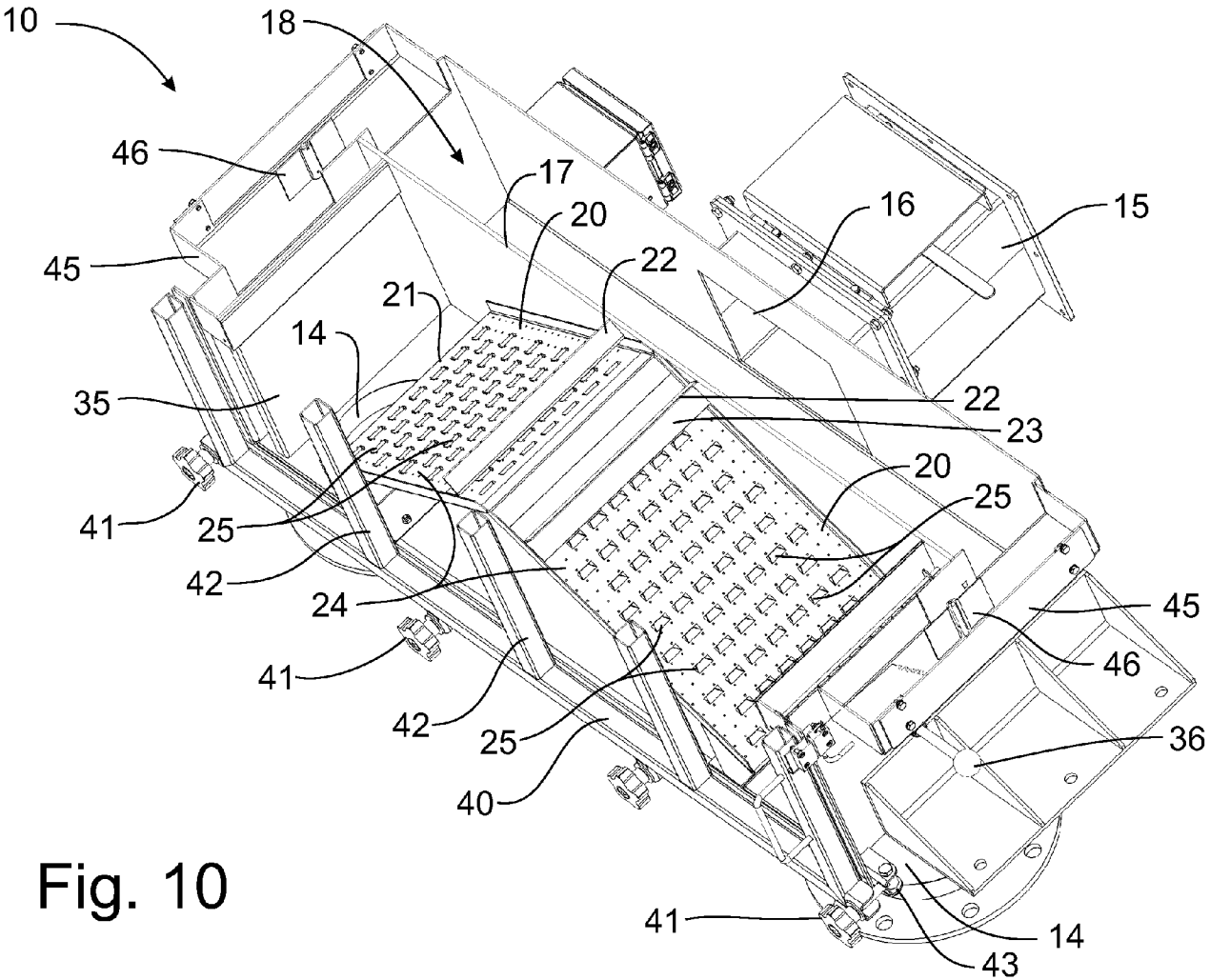
FIG. 10 is cross-sectional view of the main housing taken along lines 10-10 in FIG. 4 to show the clean air plenum.

The product particulates falling off of the lower end 21 of the respective wash decks 20 drop generally vertically toward the corresponding cleaned product outlet port 14 into a Venturi zone 30 through which air is blown upwardly through the falling product particulates to provide a vigorous finally cleaning. Air is directed into the Venturi zone 30 from beneath the wash deck 20 through louvers 29 in the support leg 28, best seen in FIG. 8. Clean air can also be directed into the Venturi zones 30 through the bypass ducts 45. As is best seen in FIG. 10, the main housing 11 is formed with a transverse, vertical central wall 17 on which the wash decks 20 are mounted. The clean air plenum or manifold 18 between the rear wall 12 and the central wall 17 is in flow communication with the clean air inlet opening 16*a* in the central wall 17 to direct a flow of air into the wash decks 20.

The clean air plenum 18 is also in flow communication with the bypass ducts 45 which direct a flow of air forwardly around the main housing 11 and back into the main housing 11 in front of the central wall 17 to be directed behind and under the pivoted members 35 into the Venturi zones 30. The amount of air moving through the bypass ducts 45 is controlled by dampers 46 pivotally mounted in the bypass ducts 45 The size of the Venturi zones 30 and the amount of air flow directed into the Venturi zones 30 is controlled by a pivoted member 35 operatively connected to a position adjustment lever 36 projecting outside of the main housing 11. The movement of the pivoted member 35 is depicted in phantom in FIG. 2.

The flow of air into the Venturi zone 30 from beneath the pivoted member 35 and through the louvers 29 presents a substantial cleaning action to the product particulates falling through the Venturi zone 30, but not so vigorous as to lift the product particulates to the dirty air exhaust port 19. If too much air is moving through the Venturi zone 30, the pivoted member 35 should be retracted to both increase the effective dimensions of the Venturi zone 30 and to decrease the amount of air moving into the Venturi zone. If the front wall 40 of the housing 11 were constructed of a transparent or semi-transparent polycarbonate, as is depicted in the drawings, the operation of the wash deck assembly could be physically viewed by looking through the front wall 40 to see if product particulates were being carried over into the dirty air exhaust port 19.

Figure 2:
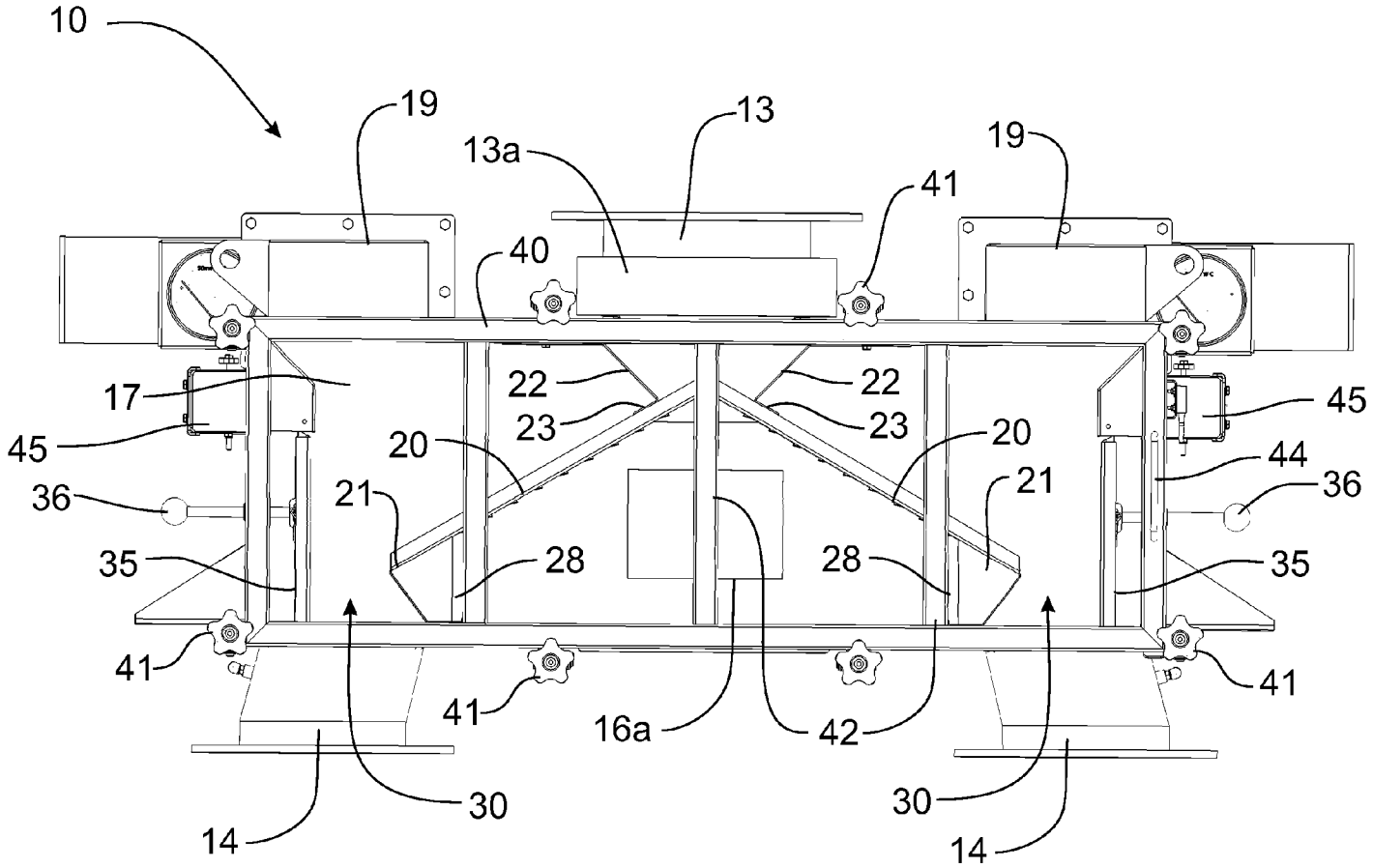
FIG. 2 is a schematic front elevational view of the dedusting apparatus shown in FIG. 1, the movement of the Venturi deflector members to control the air flow thought the Venturi zones being shown in phantom.
Figure 3:
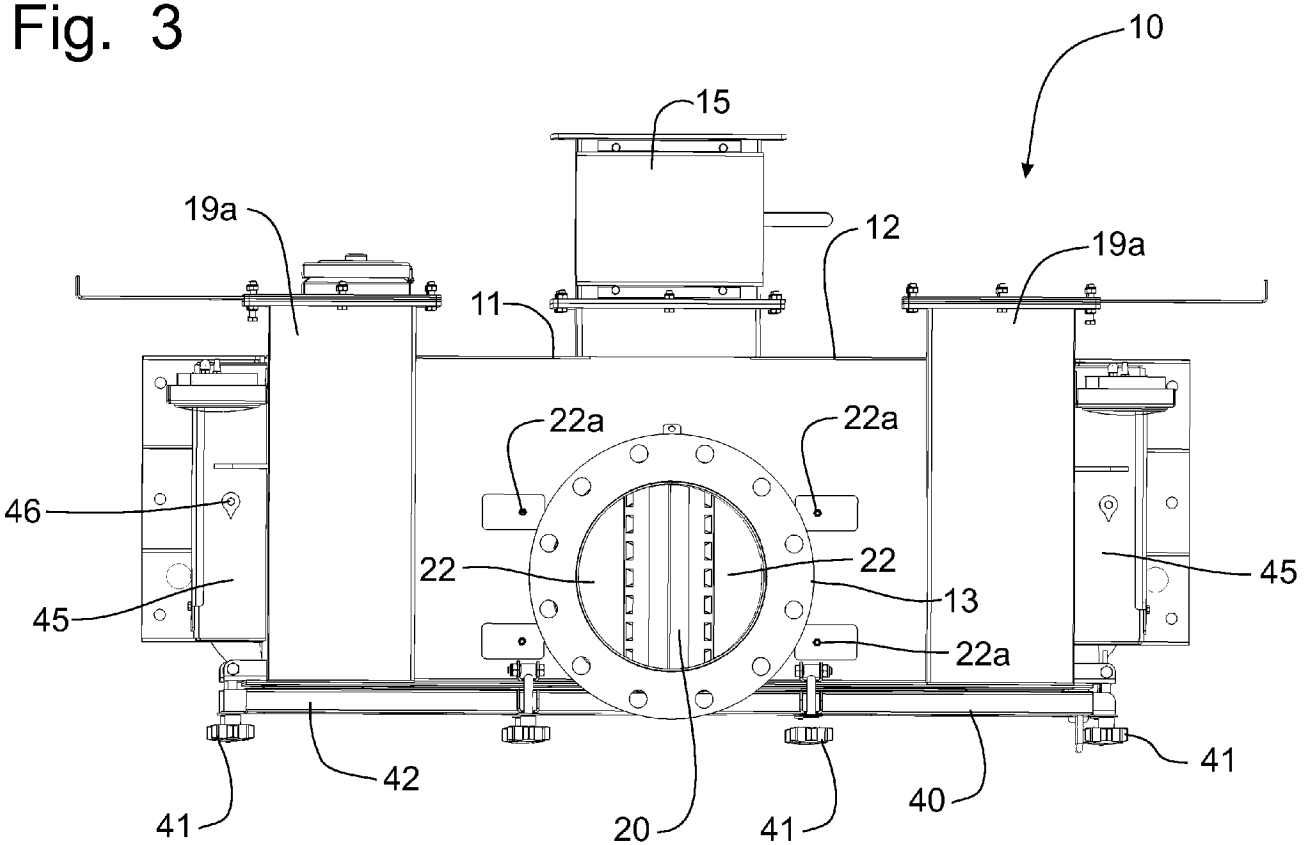
FIG. 3 is a top plan view of the dedusting apparatus shown in FIG. 1.
Figure 4:
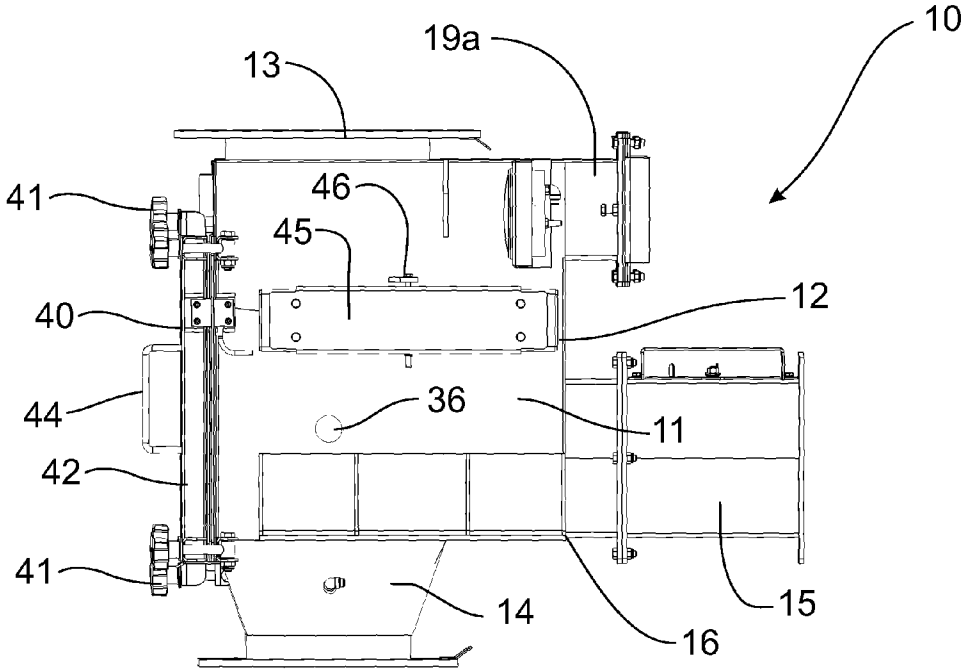
FIG. 4 is a end elevational view of the dedusting apparatus shown in FIG. 1.
Figure 5:
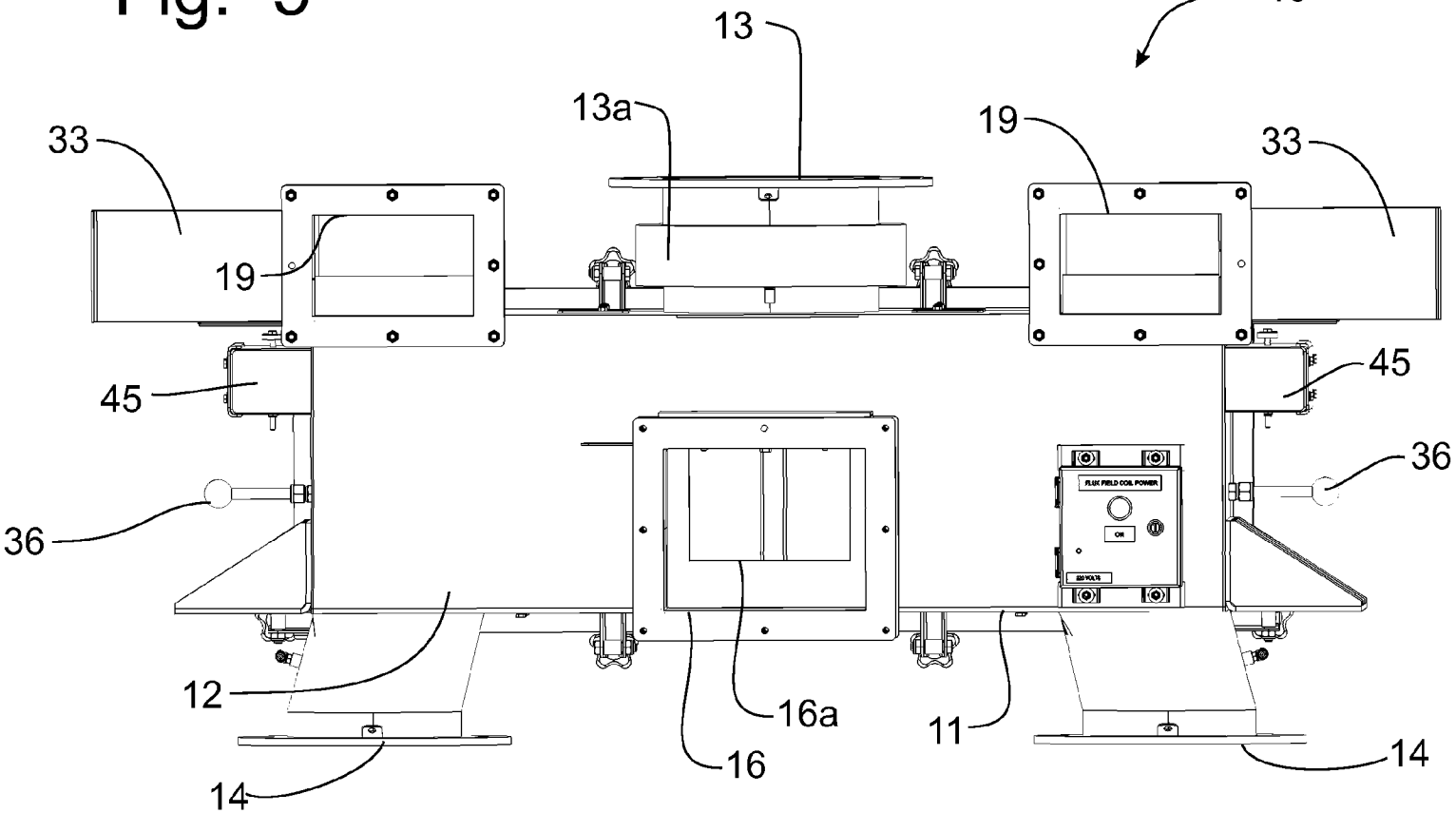
FIG. 5 is a rear elevational view of the dedusting apparatus shown in FIG. 1.
Figure 6:
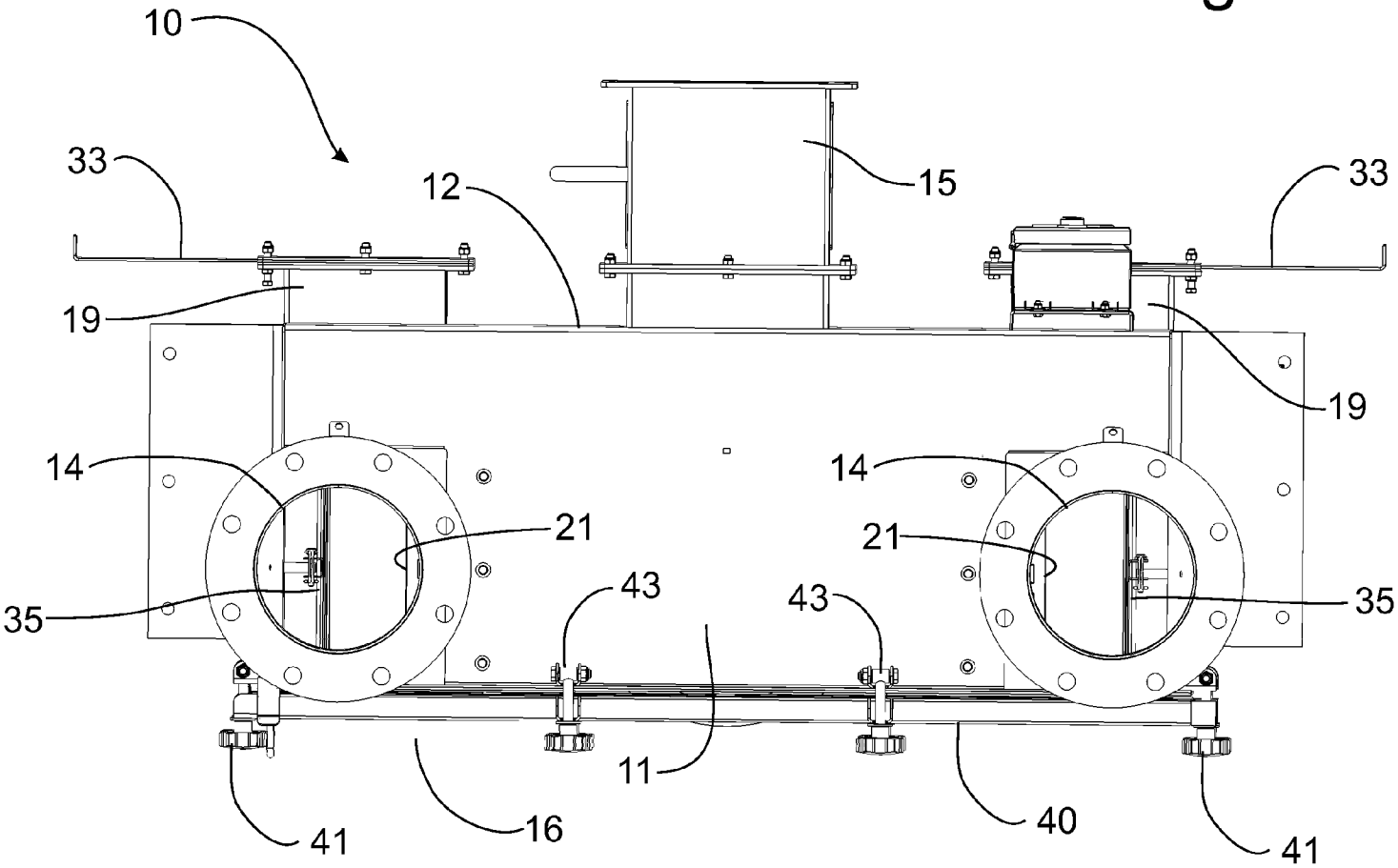
FIG. 6 is a bottom plan view of the dedusting apparatus shown in FIG. 1.
Figure 7:
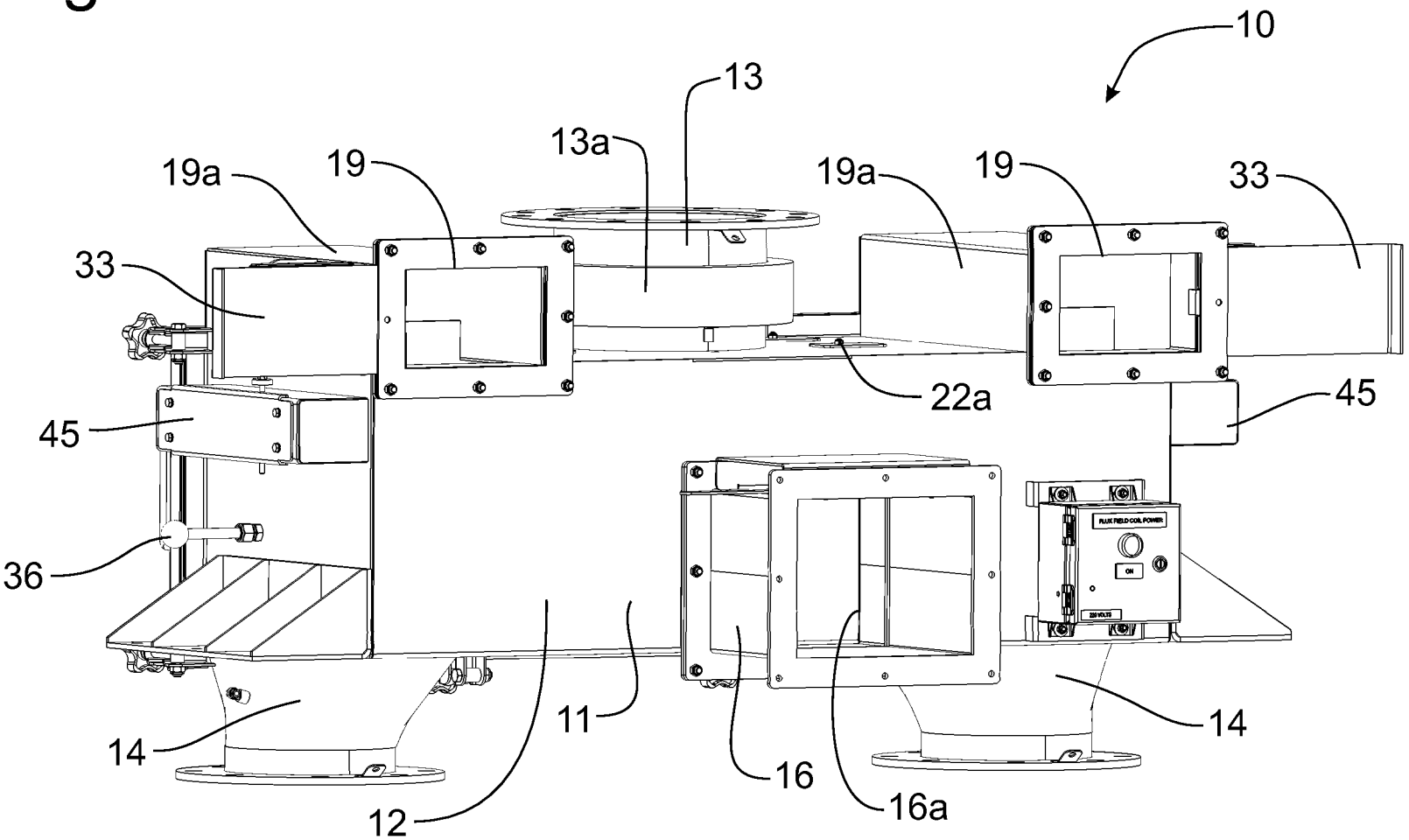
FIG. 7 is a rear perspective view of the dedusting apparatus shown in FIG. 1.
Figure 8:
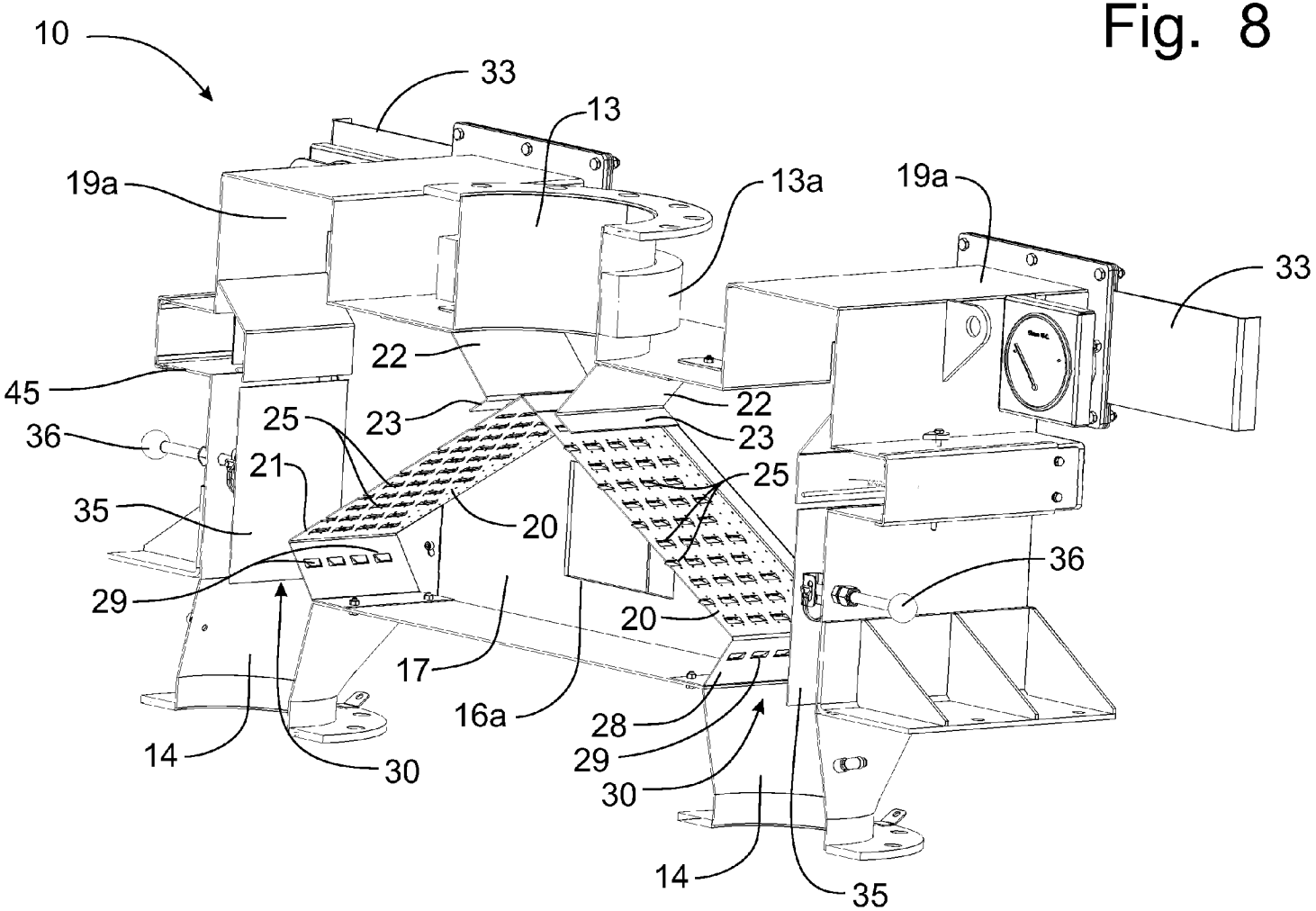
FIG. 8 is a perspective cross-sectional view of the dedusting apparatus taken along lines 8-8 of FIG. 4.
Figure 9:
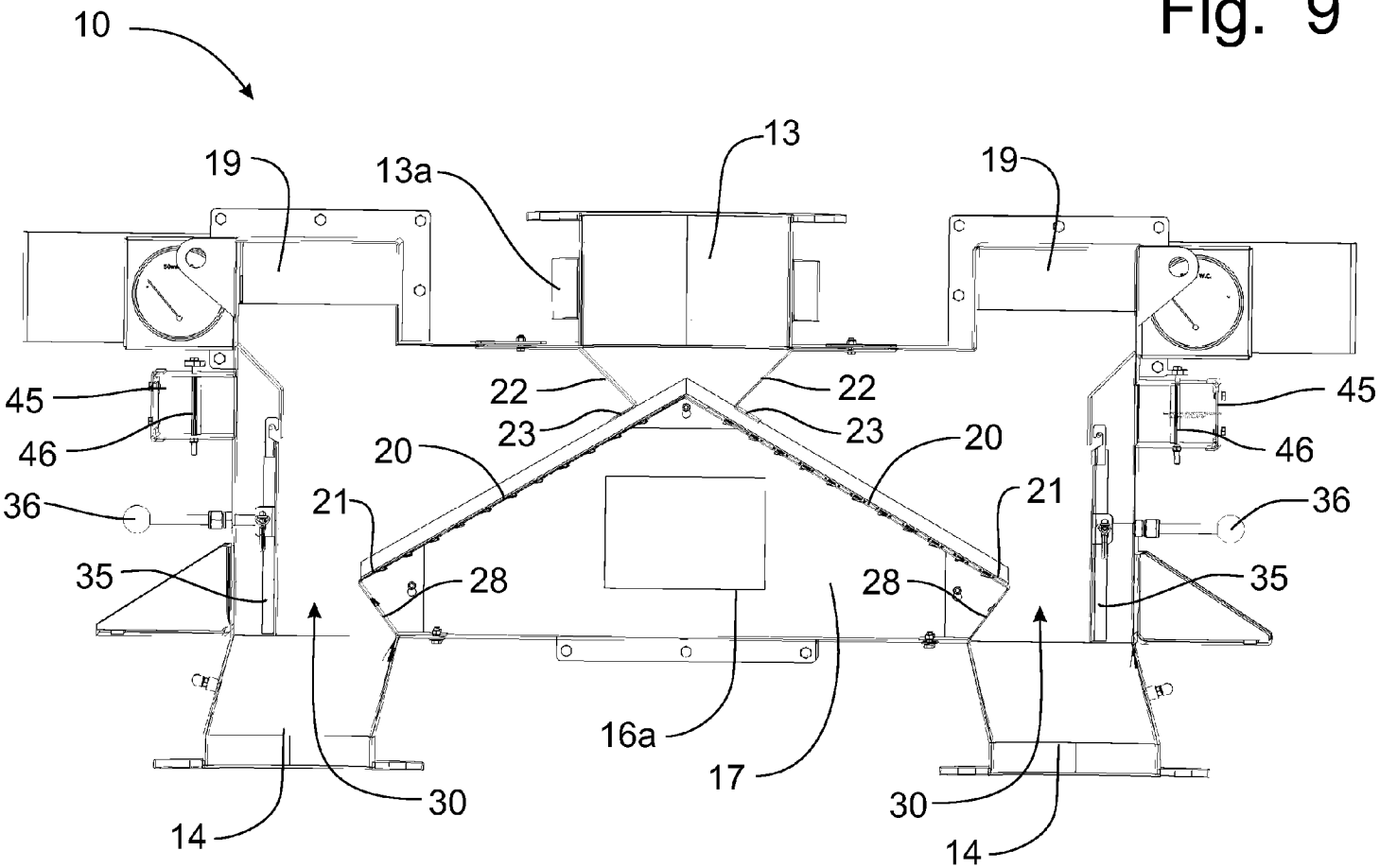
FIG. 9 is a front cross-sectional view of the dedusting apparatus corresponding to the section depicted in FIG. 8.

The support member 28 extending downwardly from the discharge edge 21 of the wash deck 20 is angled inwardly, as best seen in FIGS. 2 and 9, from the discharge edge 21 of the wash deck to engagement thereof with the housing 11. This angled configuration of the support member 28 directs the air outwardly from the louvers 29 into the Venturi zone 30 through which the particulate material falls from the discharge edge 21 of the wash deck 20. Thus, the direction of air flow from the louvers 29 passes at an angle to the vertical movement of the particulate material falling off of the wash decks 20 to provide an enhanced cleaning operation in the Venturi zone 30 which would have its narrowest horizontal dimension at the discharge edge 21.

The air flow in which the dust and debris contaminates are entrained is discharged from the housing 11 through the dirty air exhaust port 19 located at the top of the housing 11 above the Venturi zone 30 and on opposite sides of the product inlet port 13. Slidable plates 33 are mounted on the dirty air discharge passageway 19*a* to be positionally adjustable by sliding the respective plates 33 into or out of the dirty air discharge passageway 19*a*, which thus defines the throat opening of the dirty air exhaust passageway 19*a*.

The transparent front wall 40 of the housing 11 is removable from the housing 11 by releasing fasteners 41 from the frame supports 43 connecting the frame 42 of the front wall 40 to the housing 11. Alternatively, the front wall 40 can be formed as a hinged door with a handle 44 to facilitate movement of the front door 40 when released from the frame 42. With the removal of the front wall 40, the interior components, including the wash deck 20, the inlet deflector 22, and the pivoted member 35, can be removed from the housing 11 to facilitate cleaning of the interior of the housing 11 and the removed components 20, 22, 35.

The slope of the wash deck 20 is calculated to optimize product flow and air wash of the product particulates passing over the top surface 24 of the wash deck 20. The transversely spaced dual product outlet ports 14 are aligned with the ends of the corresponding wash decks 20 so that the cleaned particulate material can be packaged in two different manners. For example, separate collection bags (not shown) could be associated with each of the product outlet ports 14, or used to supply two different production lines. The oppositely positioned product outlet ports 14 provide substantial flexibility in use.

In operation, the dedusting apparatus 10 is installed at an appropriate location in conjunction with the desired utilization of the product outlet ports 14, and connected to a supply of particulate material through the product inlet port 13. The product particulates pass through the product inlet port 13 and are oriented into a laminar flow over the oppositely oriented sloped wash decks 20 by inlet deflectors 22, which are positionally adjustable relative to the wash deck 20 to define a desired product flow thickness over the wash deck 20.

Clean air is received through a clean air inlet opening 16*a* and directed into the housing 11 beneath the wash decks 20 and a flow that passes through louvers 29 in the support legs 28 for the wash decks 20 to the Venturi zones 30. The air flowing into the housing 11 beneath the wash decks 20 passes through slots 25 and openings formed in the wash decks 20. The air passing through the slots 25 and openings in the wash decks 20 create turbulence in the product particulates moving along the top surface 24 of the respective wash decks 20. Turbulence is enhanced by the upwardly projecting deflectors and the orientation of the horizontal slots 25 which accelerates the flow of the product particulates over the wash deck 20 and further creates turbulence. This movement of air through the wash decks 20 and through the flowing product particulates removes dust and debris contaminates from the product particulates, the static attraction forces having been neutralized by the magnetic flux field induced at the product inlet port 13 by the magnetic flux generator 13*a*.

The cleaned product particulates are discharged off the lower end 21 of the wash decks 20 into corresponding Venturi zones 30 having an upwardly moving air flow coming from the louvers 29 in the wash deck support leg 28 and from the bypass ducts 45 which flows behind and then under the Venturi deflector members 35 to enter the Venturi zones. This upwardly moving air flow provides a vigorous cleaning action to the product particulates falling through the Venturi zones 30 with the air flow therefrom combining with the air flow passing through the wash decks 20 to the dirty air exhaust port 19 at the top of the housing 11. The cleaned product particulates can fall through the respective product outlet ports 14 for packaging or for delivery to the manufacturing facility. The transparent front wall 40 of the housing 11 allows a visual inspection of the operation of the dedusting apparatus 10 to determine if adjustment to the inlet deflectors 22 or the Venturi deflector members 35, through manipulation of the control lever 36 to move the pivoted Venturi deflector members 35, is necessary. Furthermore, the removable front wall 40, allows convenient access to the interior of the housing 11 to facilitate cleaning of the housing 11 and all of the removable components therein.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

What is claimed is:

1. A particulate material dedusting apparatus for cleaning unwanted debris from the particulate material, comprising:

a housing;

a central infeed opening directing a flow of contaminated particulate material into the housing;

a pair of primary wash decks joined at an apex and extending downwardly and outwardly therefrom to opposing discharge edges, said apex being positioned beneath said central infeed opening to divide said flow of contaminated particulate material between said primary wash decks;

a Venturi zone located outboard of each respective discharge edge;

a discharge port supported by said housing below each respective Venturi zone so that both said discharge ports provide for a simultaneous discharge of the same particulate material as received through said central infeed opening;

a support leg supporting said discharge edge of said at least one wash deck at a position spaced above said discharge port, said support leg including louvers formed therein; and an air flow manifold directing a flow of air through openings in said primary wash decks and through said louvers in said support leg and below said discharge edges of said wash decks to provide a flow of air into the respective Venturi zones.

2. The apparatus of claim 1 wherein said housing includes a wall between said air manifold and said wash decks, said wall including a central opening positioned below said wash decks to direct air into wash decks and into said Venturi zones.

3. The apparatus of claim 2 wherein said discharge ports are offset on opposing sides of said central infeed opening.

4. The apparatus of claim 3 wherein each said wash deck includes a lower area below said upper area, said lower area terminating in said discharge edge located above the corresponding said discharge port, each said wash deck further including a support leg including openings therethrough for the passage of air upwardly into the corresponding said Venturi zone.

5. The apparatus of claim 4 wherein said support leg angles inwardly from said discharge end at said Venturi zone to engagement with said housing.

6. The apparatus of claim 5 wherein each said discharge port has a larger horizontal dimension than a corresponding horizontal dimension of said Venturi zone at the corresponding said discharge edge.

7. The apparatus of claim 4 wherein said lower area of each said wash deck is formed with openings, each said opening including a slot formed to direct a flow of air from said opening downwardly along said wash deck in the general direction of the flow of particulate material over the wash deck.

8. The apparatus of claim 7 wherein each of the slots are formed with a deflector structure projecting upwardly from the upper surface of said wash deck, each said deflector structure aiding in directing the flow of air downwardly along the upper surface of the wash deck and causing turbulence in the flow of particulate material along the upper surface of the wash deck toward said discharge end.

9. A dedusting apparatus for removing dust and debris from a flow of particulate material, comprising:

a housing defining a central product inlet opening;

double wash decks defining a pair of oppositely directed, downwardly sloped upper surfaces terminating at respective discharge ends and being positioned to receive particulate material from said product inlet opening to flow along said upper surfaces, each said wash deck being formed with openings therethrough to allow a passage of air through said wash deck into the flow of particulate material over the upper surface of said wash deck, a portion of said openings through said wash deck being formed as elongated slots directing a flow of air therefrom downwardly along said wash deck in the general direction of the flow of particulate material over the upper surface of said wash deck, said wash decks meeting at an apex centered under said product inlet opening to provide an equal division of the central product area for each respective wash deck;

a manifold directing air beneath said double wash decks; and a pair of product outlet openings aligned with a discharge end of each said wash deck to receive cleaned particulate material therefrom; each said product outlet opening being laterally offset on opposing sides of said product inlet opening such that said product inlet opening and neither of said product outlet openings are vertically aligned, said double wash decks being positioned beneath said central product inlet opening so that said product outlet openings simultaneously discharge substantially equal flows of the same cleaned particulate material received from said central product inlet opening as discharged from the respective said wash decks.

10. The dedusting apparatus of claim 9 wherein each of the slots are formed with a deflector structure projecting upwardly from the upper surface of said wash deck, said deflector structure aiding in directing the flow of air downwardly along the upper surface of the wash deck and causing turbulence in the flow of particulate material along the upper surface of the respective said wash deck toward said discharge end.

11. The dedusting apparatus of claim 10 wherein a Venturi zone is defined between each respective said discharge end of said wash decks and the corresponding said product outlet opening, each said wash deck further including a support leg supporting the discharge end above the corresponding said product outlet opening, each said support leg including openings therethrough for the passage of air upwardly therefrom into the corresponding said Venturi zone.

12. The dedusting apparatus of claim 11 wherein each said support leg is oriented inwardly away from the corresponding said discharge end at said Venturi zone to align with said product outlet opening which has a larger horizontal dimension than a corresponding horizontal dimension of said Venturi zone at said discharge edge.

13. The dedusting apparatus of claim 12 wherein said air manifold also directs a flow of air into a pair of Venturi inlet ports located along laterally spaced sides of said housing to enter each respective Venturi zone oppositely of said flow of air through the corresponding said support leg.

14. The dedusting apparatus of claim 9 wherein each said wash deck includes an inlet deflector positioned at said upper area to create a generally laminar flow of contaminated product material over said upper surface of each respective said wash deck.

15. A particulate material dedusting apparatus for cleaning unwanted debris from the particulate material, comprising:

a housing;

a central infeed opening directing a flow of contaminated particulate material into the housing;

at least one wash deck to receive said flow of contaminated particulate material from said central infeed opening and extending downwardly and outwardly from said central infeed opening to terminate at a lower discharge edge;

a Venturi zone located outboard of said discharge edge;

a discharge port supported by said housing below said Venturi zone;

a support leg supporting said discharge edge of said at least one wash deck at a position spaced above said discharge port, said support leg being oriented at a non-vertical angle extending inwardly from said discharge edge, said support leg including louvers formed therein; and an air flow manifold directing a flow of air through openings in said primary wash decks and through said louvers in said support leg to provide a flow of air into said Venturi zone from below said discharge edge of said wash deck.

16. The dedusting apparatus of claim 15 wherein Venturi zone has a smallest horizontal dimension at said discharge edge of said wash deck.

17. The dedusting apparatus of claim 16 wherein said discharge port has a larger horizontal dimension than said smallest horizontal dimension of said Venturi zone.

18. The dedusting apparatus of claim 15 wherein said dedusting apparatus has a pair of wash decks joined at an apex beneath said central infeed opening, each said wash deck extending downwardly and outwardly from said apex in opposing directions and terminating in corresponding discharge edges.

19. The dedusting apparatus of claim 18 wherein said housing is formed with a pair of laterally opposing discharge ports positioned, respectively, beneath opposing Venturi zones and below respective discharge edges, each said discharge port being spaced laterally from said central infeed opening.

20. The dedusting apparatus of claim 19 wherein each said wash deck is formed with openings for the passage of air from said air flow manifold into the flow of particulate material over an upper surface of said wash deck, each said opening including a slot formed to direct a flow of air from said opening downwardly along said wash deck in the general direction of the flow of particulate material over the wash deck, each said slot is formed with a deflector structure projecting upwardly from the upper surface of said wash deck, each said deflector structure aiding in directing the flow of air downwardly along the upper surface of the wash deck and causing turbulence in the flow of particulate material along the upper surface of the wash deck toward said discharge end.

* * * * *